US006019193A

United States Patent [19]

Brown

[11] Patent Number: 6,019,193

[45] Date of Patent: Feb. 1, 2000

[54] SAWHORSE SYSTEM

[76] Inventor: Barbara M. Brown, H.C. 1 Box 163, Old Town, Fla. 32680

[21] Appl. No.: 09/352,833

[22] Filed: Jul. 13, 1999

[51] Int. Cl.[7] ..... B27B 27/00

[52] U.S. Cl. ..... 182/153; 182/186.5

[58] Field of Search ..... 182/153, 151, 182/186.5, 181, 225

[56] References Cited

U.S. PATENT DOCUMENTS

| | | | |
|---|---|---|---|
| 395,381 | 1/1889 | Casler . | |
| 3,148,746 | 9/1964 | Juculano . | |
| 4,031,198 | 6/1977 | Spencer | 182/153 |
| 4,502,563 | 3/1985 | Peishon | 182/153 |
| 5,377,779 | 1/1995 | Slapnicka | 182/153 |
| 5,467,842 | 11/1995 | Meloy | 182/153 |
| 5,647,455 | 7/1997 | Russell | 185/153 |
| 5,704,450 | 1/1998 | Lunceford | 182/153 |
| 5,839,540 | 11/1998 | Russell | 182/153 |

*Primary Examiner*—Alvin Chin-Shue
*Attorney, Agent, or Firm*—Joseph N. Breaux

[57] ABSTRACT

A sawhorse system that constructed from readily available, rigid plastic tubing and rigid plastic tubing connecters including L-shaped elbows and T-shaped connectors to provide a lightweight sturdy sawhorse that is not subject to damage from the elements and which is collapsible for easy storage.

1 Claim, 2 Drawing Sheets

SAWHORSE SYSTEM

TECHNICAL FIELD

The present invention relates to collapsible saw horses and more particularly to a sawhorse system that includes a hinged frame assembly including an inner leg assembly, an outer leg assembly, a horizontal hinge bar assembly having three pipe sections, two raised L-shaped outer leg hinge structures rotatably each connected to only one of the three pipe sections and two raised T-shaped inner leg hinge structures each rotatably connected to two of the three pipe sections and positioned between the two raised L-shaped outer leg hinge structures, and two flexible leg assembly support straps secured between the inner and outer leg assemblies; four adjustable height leg securing spikes, one slidably installed within a tubular bottom end of each leg of the each of the inner and outer leg assemblies; four spike locking pins each insertable through alignable positioning holes formed through the bottom end of each leg of the each of the inner and outer leg assemblies and the spike top portion of each leg securing spike; a molded plastic work surface member having a flat upper surface through which a number of securing pin apertures are formed and which are positionable in registration with a like number of hinge bar assembly securing pin apertures formed into the three pipe sections of the hinge bar assembly and a recessed undersurface including a shape conforming recess for each of the three pipe section, each of the two raised L-shaped outer leg hinge structures and each of the two raised T-shaped inner leg hinge structures; and a work surface member securing pin for each of the number of securing pin apertures formed through the work surface member.

BACKGROUND ART

Sawhorses are used in a variety of remote construction locations to support work pieces and the like. Because the sawhorses are used at remote locations, it would be a benefit to have a sawhorse system that was constructed from readily available, rigid plastic tubing and rigid plastic tubing connecters such as L-shaped elbows and T-shaped T connectors to provide a lightweight sturdy sawhorse that is not subject to damage from the elements and which is collapsible for easy storage.

GENERAL SUMMARY DISCUSSION OF INVENTION

It is thus an object of the invention to provide a sawhorse system that includes a hinged frame assembly including an inner leg assembly, an outer leg assembly, a horizontal hinge bar assembly having three pipe sections, two raised L-shaped outer leg hinge structures rotatably each connected to only one of the three pipe sections and two raised T-shaped inner leg hinge structures each rotatably connected to two of the three pipe sections and positioned between the two raised L-shaped outer leg hinge structures, and two flexible leg assembly support straps secured between the inner and outer leg assemblies; four adjustable height leg securing spikes, one slidably installed within a tubular bottom end of each leg of the each of the inner and outer leg assemblies; four spike locking pins each insertable through alignable positioning holes formed through the bottom end of each leg of the each of the inner and outer leg assemblies and the spike top portion of each leg securing spike; a molded plastic work surface member having a flat upper surface through which a number of securing pin apertures are formed and which are positionable in registration with a like number of hinge bar assembly securing pin apertures formed into the three pipe sections of the hinge bar assembly and a recessed undersurface including a shape conforming recess for each of the three pipe section, each of the two raised L-shaped outer leg hinge structures and each of the two raised T-shaped inner leg hinge structures; and a work surface member securing pin for each of the number of securing pin apertures formed through the work surface member.

Accordingly, a sawhorse system is provided. The sawhorse system includes a hinged frame assembly including an inner leg assembly, an outer leg assembly, a horizontal hinge bar assembly having three pipe sections, two raised L-shaped outer leg hinge structures rotatably each connected to only one of the three pipe sections and two raised T-shaped inner leg hinge structures each rotatably connected to two of the three pipe sections and positioned between the two raised L-shaped outer leg hinge structures, and two flexible leg assembly support straps secured between the inner and outer leg assemblies; four adjustable height leg securing spikes, one slidably installed within a tubular bottom end of each leg of the each of the inner and outer leg assemblies; four spike locking pins each insertable through alignable positioning holes formed through the bottom end of each leg of the each of the inner and outer leg assemblies and the spike top portion of each leg securing spike; a molded plastic work surface member having a flat upper surface through which a number of securing pin apertures are formed and which are positionable in registration with a like number of hinge bar assembly securing pin apertures formed into the three pipe sections of the hinge bar assembly and a recessed undersurface including a shape conforming recess for each of the three pipe section, each of the two raised L-shaped outer leg hinge structures and each of the two raised T-shaped inner leg hinge structures; and a work surface member securing pin for each of the number of securing pin apertures formed through the work surface member.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
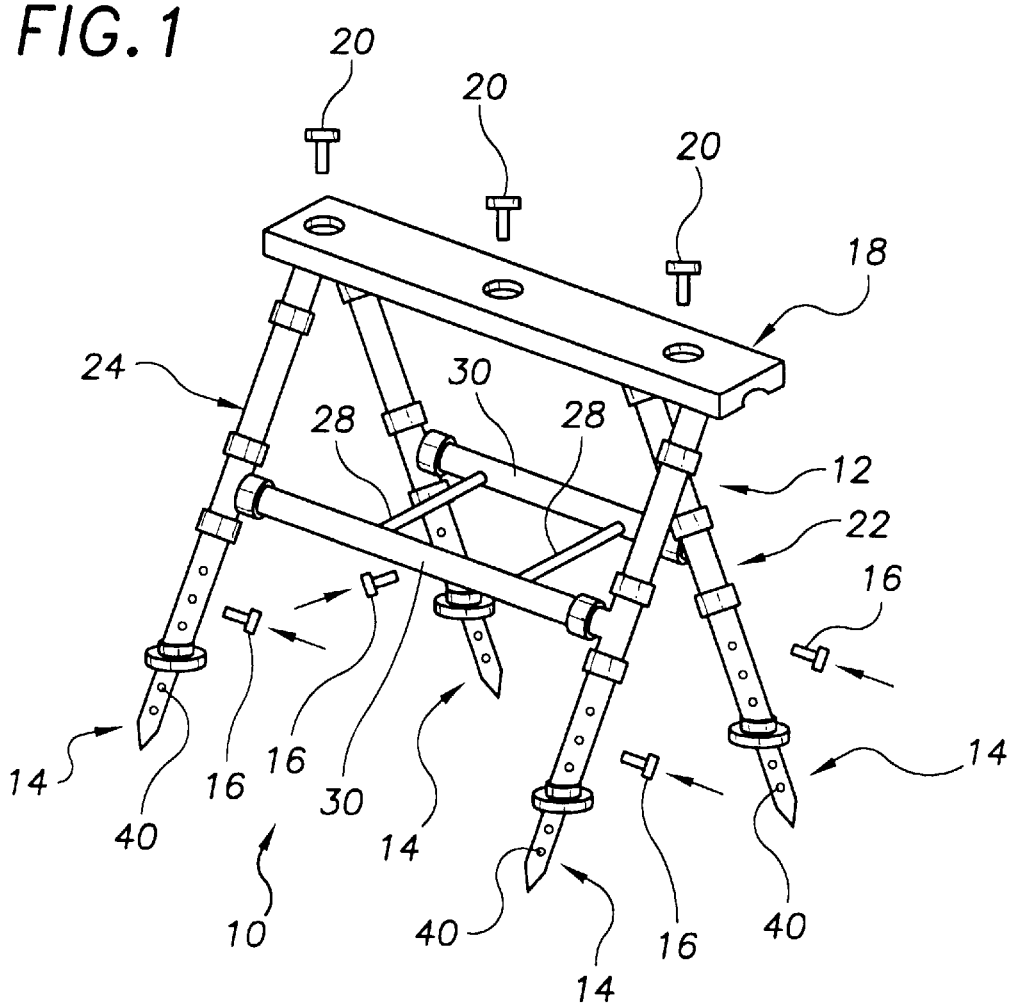
FIG. 1 is a perspective view of an exemplary embodiment of the saw horse system showing the hinged frame assembly including the inner leg assembly, the outer leg assembly, the horizontal hinge bar assembly having three pipe sections, two raised L-shaped outer leg hinge structures rotatably each connected to only one of the three pipe sections and two raised T-shaped inner leg hinge structures each rotatably connected to two of the three pipe sections and positioned between the two raised L-shaped outer leg hinge structures, and the two flexible leg assembly support straps secured between the inner and outer leg assemblies; the four adjustable height leg securing spikes, one slidably installed within a tubular bottom end of each leg of the each of the inner and outer leg assemblies; four spike locking pins each insertable through alignable positioning holes formed through the bottom end of each leg of the each of the inner and outer leg assemblies and the spike top portion of each leg securing spike; the molded plastic work surface member having a flat upper surface through which a number of securing pin apertures are formed and which positionable in registration with a like number of hinge bar assembly securing pin apertures formed into the three pipe sections of the hinge bar assembly and a recessed undersurface including a shape conforming recess for each of the three pipe section, each of the two raised L-shaped outer leg hinge structures and each of the two raised T-shaped inner leg hinge structures; and a work surface member securing pin for each of the number of securing pin apertures formed through the work surface member.

FIG. 1 shows an exemplary embodiment of the saw horse system of the present invention, generally designated 10. Sawhorse system includes a hinged frame assembly, generally designated 12; four adjustable height leg securing spikes, each generally designated 14; four spike locking pins 16; a molded plastic work surface member, generally designated 18; and three work surface member securing pins 20.

Figure 3:
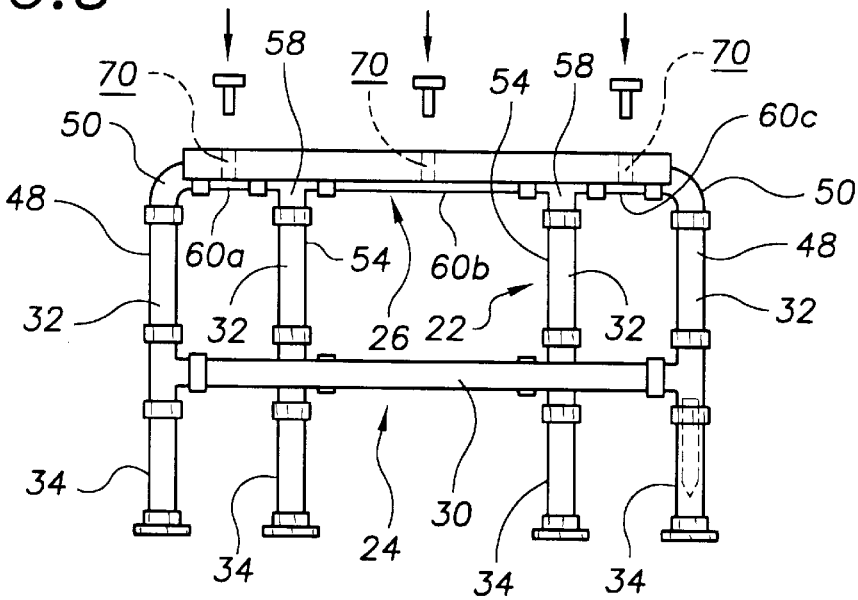
FIG. 3 is an outer leg assembly side view of the sawhorse system of FIG. 1.

Hinged frame assembly 12 is generally constructed of PVC pipe and pipe fittings and includes an inner leg assembly, generally designated 22; an outer leg assembly, generally designated 24; a horizontal hinge bar assembly, generally designated 26 (FIG. 3); and two flexible leg assembly support straps 28 secured between inner and outer leg assemblies 22,24. Referring to FIG. 3, inner and outer leg assemblies 22,24 each include a cross member 30 (see also FIG. 1) connecting two leg tubes 32. A tubular bottom portion 34 of each leg tube 32 is provided with a number of alignable positioning holes 36 that are alignable with positioning holes 40 formed through the spike top portion of each leg securing spike 14 (FIG. 1). Leg securing spikes 14 are secured in fixed relation to leg tubes 32 by aligning a positioning hole 36 with a positioning hole 40 (FIG. 1) and inserting therein a spike locking pin 16. In use the tip ends of leg securing spikes 14 are pushed into the ground.

At top end 48 of each leg tube 32 of inner leg assembly 24 is connected to a T-shaped inner leg hinge structure 50. A top end 54 of each leg tube 32 of outer leg assembly 24 is connected to a separate L-shaped outer leg hinge structure 58. Horizontal hinge bar assembly includes three pipe sections 60*a–c*, the two raised L-shaped outer leg hinge structures 50 which are each rotatably connected to only one of pipe sections 60*a*,60*c* and the two raised T-shaped inner leg hinge structures 58 that are each rotatably connected to two of the three pipe sections 60*a–c*. The use of rotatably connected L-shaped outer leg hinge structures 50 and T-shaped inner leg hinge structures 58 allows, with reference now to FIG. 2, inner and outer leg assemblies 24,26 to pivot into an A-frame shape with flexible leg assembly support straps 28 secured therebetween.

Figure 4:
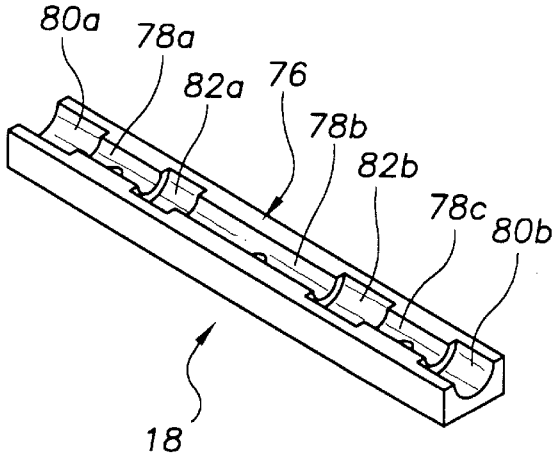
FIG. 4 is a perspective view of the undersurface of the molded plastic work surface member showing the seven shape conforming recesses, one for each of the three pipe sections, each of the two raised L-shaped outer leg hinge structures and each of the two raised T-shaped inner leg hinge structures.
Figure 5:
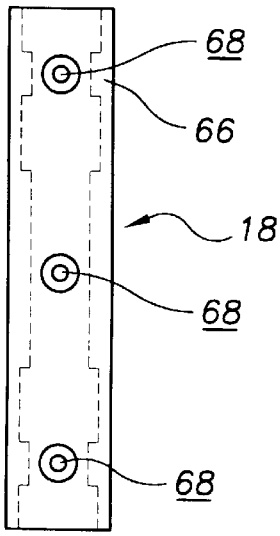
FIG. 5 is a top plan view of the top surface of the molded plastic work surface member showing the flat upper surface and the three securing pin apertures.

Referring to FIG. 5, molded plastic work surface member 18 s a flat upper surface 66 through which a number of securing pin apertures 68 are formed and which are positionable in registration th a like number of hinge bar assembly securing pin apertures 70 (Shown in dashed lines FIG. 3) formed into the three pipe sections 60*a–c* (FIG. 3) and, referring now to FIG. 4, a recessed undersurface, generally designated 76, including three pipe section recesses 78*a–c*, two raised L-shaped outer leg hinge structure recesses 80*a*,80*b* and two raised T-shaped inner leg hinge structure recesses 82*a*,82*b*. The two raised L-shaped outer leg hinge structure recesses 80*a*,80*b* and the two raised T-shaped inner leg hinge structure recesses 82*a*,82*b* are each semi-cylindrical in shape and sized to conformably fit over, respectively, the L-shaped outer leg hinge structures 50 and the T-shaped inner leg hinge structures 58.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein:

FIG. 1 is a perspective view of an exemplary embodiment of the saw horse system showing the hinged frame assembly including the inner leg assembly, the outer leg assembly, the horizontal hinge bar assembly having three pipe sections, two raised L-shaped outer leg hinge structures rotatably each connected to only one of the three pipe sections and two raised T-shaped inner leg hinge structures each rotatably connected to two of the three pipe sections and positioned between the two raised L-shaped outer leg hinge structures, and the two flexible leg assembly support straps secured between the inner and outer leg assemblies; the four adjustable height leg securing spikes, one slidably installed within a tubular bottom end of each leg of the each of the inner and outer leg assemblies; four spike locking pins each insertable through alignable positioning holes formed through the bottom end of each leg of the each of the inner and outer leg assemblies and the spike top portion of each leg securing spike; the molded plastic work surface member having a flat upper surface through which a number of securing pin apertures are formed and which positionable in registration with a like number of hinge bar assembly securing pin apertures formed into the three pipe sections of the hinge bar assembly and a recessed undersurface including a shape conforming recess for each of the three pipe section, each of the two raised L-shaped outer leg hinge structures and each of the two raised T-shaped inner leg hinge structures; and a work surface member securing pin for each of the number of securing pin apertures formed through the work surface member.

For each of the number of securing pin apertures formed through the work surface member.

Figure 2:
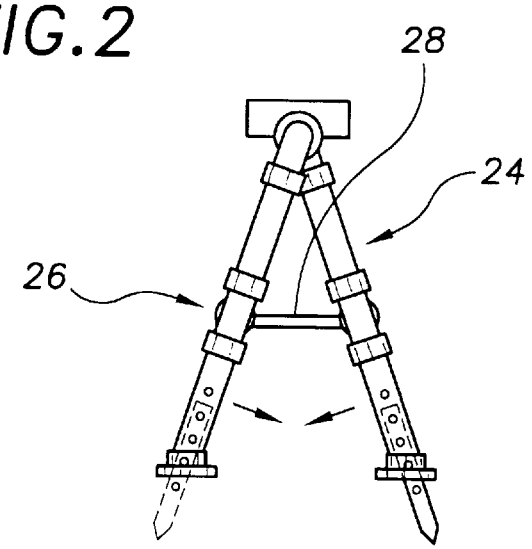
FIG. 2 is an end plan view of the sawhorse system of FIG. 1.

FIG. 2 is an end plan view of the sawhorse system of FIG. 1.

FIG. 3 is an outer leg assembly side view of the sawhorse system of FIG. 1.

FIG. 4 is a perspective view of the undersurface of the molded plastic work surface member showing the seven shape conforming recesses, one for each of the three pipe sections, each of the two raised L-shaped outer leg hinge structures and each of the two raised T-shaped inner leg hinge structures.

FIG. 5 is a top plan view of the top surface of the molded plastic work surface member showing the flat upper surface and the three securing pin apertures.

It can be seen from the preceding description that a sawhorse system has been provided that includes a hinged frame assembly including an inner leg assembly, an outer leg assembly, a horizontal hinge bar assembly having three pipe sections, two raised L-shaped outer leg hinge structures rotatably each connected to only one of the three pipe sections and two raised T-shaped inner leg hinge structures each rotatably connected to two of the three pipe sections and positioned between the two raised L-shaped outer leg hinge structures, and two flexible leg assembly support traps secured between the inner and outer leg assemblies; four adjustable height leg securing spikes, one slidably installed within a tubular bottom end of each leg of the each of the inner and outer leg assemblies; four spike locking pins each insertable through alignable positioning holes formed through the bottom end of each leg of the each of the inner and outer leg assemblies and the spike top portion of each leg securing spike; a molded plastic work surface member having a flat upper surface through which a number of securing pin apertures are formed and which are positionable in registration with a like number of hinge bar assembly securing pin apertures formed into the three pipe sections of the hinge bar assembly and a recessed undersurface including a shape conforming recess for each of the three pipe section, each of the two raised L-shaped outer leg hinge structures and each of the two raised T-shaped inner leg hinge structures; and a work surface member securing pin for each of the number of securing pin apertures formed through the work surface member.

It is noted that the embodiment of the sawhorse system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A sawhorse system comprising:

a hinged frame assembly including an inner leg assembly, an outer leg assembly, a horizontal hinge bar assembly having three pipe sections, two raised L-shaped outer leg hinge structures each rotatably connected to only one of said three pipe sections and two raised T-shaped inner leg hinge structures each rotatably connected to two of said three pipe sections and positioned between said two raised L-shaped outer leg hinge structures, and two flexible leg assembly support straps secured between said inner and outer leg assemblies; said inner and outer leg assemblies having a plurality of legs, four adjustable height leg securing spikes, one slidably installed within a tubular bottom end of each leg of said inner and outer leg assemblies;

four spike locking pins each insertable through alignable positioning holes formed through said tubular bottom end of each leg of said inner and outer leg assemblies and top portion of each leg securing spike;

a molded plastic work surface member having a flat upper surface through which a number of securing pin apertures are formed and which are positionable in registration with a like number of hinge bar assembly securing pin apertures formed into said three pipe sections of said hinge bar assembly and a recessed undersurface including a shape conforming recess for each of said three pipe section, each of said two raised L-shaped outer leg hinge structures and each of said two raised T-shaped inner leg hinge structures; and a work surface member securing pin for each of said number of securing pin apertures formed through said work surface member.

* * * * *